US012606957B2

(12) United States Patent
Rauvanto et al.

(10) Patent No.: US 12,606,957 B2
(45) Date of Patent: Apr. 21, 2026

(54) PULP MIXTURE

(71) Applicant: Billerudkorsnas AB, Solna (SE)

(72) Inventors: Irina Rauvanto, Sjundea (FI); Lars Hilden, Norrkoping (SE)

(73) Assignee: ALPLA WERKE ALWIN LEHNER GMBH & CO KG, Hard (AT)

( * ) Notice: Subject to any disclaimer, the term of this patent is extended or adjusted under 35 U.S.C. 154(b) by 216 days.

(21) Appl. No.: 18/223,509

(22) Filed: Jul. 18, 2023

(65) Prior Publication Data

US 2023/0407568 A1 Dec. 21, 2023

Related U.S. Application Data

(62) Division of application No. 16/621,926, filed as application No. PCT/EP2018/066458 on Jun. 20, 2018, now Pat. No. 11,746,472.

(30) Foreign Application Priority Data

Jun. 21, 2017 (EP) ..... 17177184

(51) Int. Cl.

| | |
|---|---|
| ***D21H 11/00*** | (2006.01) |
| ***D21D 1/20*** | (2006.01) |
| ***D21H 27/00*** | (2006.01) |
| ***D21J 1/08*** | (2006.01) |
| ***D21J 3/10*** | (2006.01) |

(52) U.S. Cl.

CPC ..... *D21H 11/00* (2013.01); *D21D 1/20* (2013.01); *D21H 27/00* (2013.01); *D21J 1/08* (2013.01); *D21J 3/10* (2013.01)

(58) Field of Classification Search

CPC ..... D21H 11/00
USPC ..... 162/222
See application file for complete search history.

(56) References Cited

U.S. PATENT DOCUMENTS

2012/0313145 A1* 12/2012 Makabe ..... H01L 21/0254 257/E29.246

FOREIGN PATENT DOCUMENTS

| | | | |
|---|---|---|---|
| EP | 2947203 | A2 | 11/2015 |
| WO | WO2016055072 | A1 | 4/2016 |
| WO | WO2016140609 | A1 | 9/2016 |

* cited by examiner

*Primary Examiner* — Jacob T Minskey
(74) *Attorney, Agent, or Firm* — Stites & Harbison PLLC; Richard S. Myers, Jr.

(57) ABSTRACT

There is provided a use of a pulp mixture for forming a container in a mould, which pulp mixture comprises: 65-90%, such as 70-84%, by dry weight of a first pulp having a Schopper-Riegler (SR) number of below 48, preferably below 40, more preferably below 30; and 10-35%, such as 16-30%, by dry weight of a second pulp having a Schopper-Riegler (SR) number of 60-90, preferably 70-90, more preferably 77-90. A pulp mixture and a method of producing a pulp mixture are also provided.

21 Claims, 2 Drawing Sheets

PULP MIXTURE

CROSS REFERENCE TO RELATED APPLICATIONS

This application is a divisional of U.S. application Ser. No. 16/621,926; filed Dec. 12, 2019; which is a § 371 National Phase Application of PCT/EP2018/066458 filed Jun. 20, 2018; which claims priority to EP17177184.3, filed Jun. 24, 2017.

TECHNICAL FIELD

The invention relates to a pulp mixture as well as a preparation and uses thereof.

BACKGROUND

Modern packaging technology has made it possible to store and distribute food and beverages safely and conveniently, preventing contamination and spoiling and extending the shelf life and simplifying handling in a fashion totally unprecedented in history. While this development has helped to minimize the waste of food and greatly simplified the distribution of food on a global scale, it has also resulted in increased amounts of packaging waste that needs to be addressed, preferably recycled.

Traditionally beverages have been supplied in glass bottles and canned food in glass jars or metal cans. Systems for the collection and recycling of glass and metals have been established, but require a certain degree of consumer engagement and participation as the bottles, jars and cans need to be separated from other waste. In countries where there is a tradition of consumer awareness and recycling and the necessary systems are in place, a large portion of packaging glass and metal is already recycled. This results in considerable savings in energy and natural resources. However, a portion of glass and metal packaging still unfortunately end up in landfills. Further, glass and metal packaging is heavy and a reduction of weight would help to save energy in the distribution chain.

Plastic bottles and containers offer a solution for a lighter packaging and plastics such as PET and HDPE are well suited for packaging foods and beverages. The blow moulded bottle is a widely used packaging, in particular for liquid goods, such as beverages.

To provide an alternative to plastic containers, WO16055072 discloses a method for producing a moulded article, in particular a tray-shaped article, from fibrous pulp, such as paper pulp. In the method, pressure and heat is used for dewatering the fibrous pulp and forming the moulded article in a split mould.

Similarly, WO16055073 discloses another method for producing a moulded article, in particular a bottle-shaped article, from fibrous pulp, such as paper pulp. In the method, pressure exerted e.g. by inflating a pressing tool and heat is used for dewatering the fibrous pulp and forming the moulded article in a split mould.

SUMMARY

The present inventors have realized that the strength of the walls of a container formed from pulp in a mould can be increased by modifying the composition of the pulp. The present inventors have also realized that the pulp composition affects how quickly the pulp can be dewatered in the mould.

Accordingly, the object of the present disclosure is to provide a pulp composition that can be used in a method of forming a container in a mould, such as the method of WO16055072 or WO1605573, and results in container walls of great strength. Another object is to provide a pulp that allows containers to be formed in the mould at great speed.

The present disclosure presents the following itemized listing of embodiments.

1. Use of a pulp mixture for forming a container in a mould, which pulp mixture comprises:

65-90%, such as 70-84%, by dry weight of a first pulp having a Schopper-Riegler (SR) number of below 48, preferably below 40, more preferably below 30; and 10-35%, such as 16-30%, by dry weight of a second pulp having a Schopper-Riegler (SR) number of 60-90, preferably 70-90, more preferably 77-90.

2. The use of item 1, wherein the first pulp is an optionally refined resuspended market pulp.
3. The use of item 1 or 2, wherein the second pulp is a refined resuspended market pulp.
4. The use of any one of the preceding items, wherein the first pulp comprises softwood pulp.
5. The use of item 4, wherein the first pulp comprises at least 50% chemical softwood pulp, preferably at least 75% chemical softwood pulp and more preferably at least 90% chemical softwood pulp based of the dry weight of the first pulp.
6. The use of any one of the preceding items, wherein the second pulp comprises softwood pulp.
7. The use of item 6, wherein the second pulp comprises at least 50% chemical softwood pulp, preferably at least 75% chemical softwood pulp and more preferably at least 90% chemical softwood pulp based of the dry weight of the first pulp.
8. The use of any one of the preceding items, wherein the length-weighted fibre length of the first pulp is above 1.75 mm, such as 1.8-2.2 mm according to TAPPI T271.
9. The use of any one of the preceding items, wherein the length-weighted fibre length of the second pulp is 1.2-1.75 mm, such as 1.3-1.7 mm according to TAPPI T271.
10. The use of any one of the preceding items, wherein the length-weighted proportion of fibres having a length below 0.2 mm in the first pulp is below 5.0%, preferably below 4.1%, when measured according to TAPPI T271.
11. The use of any one of the preceding items, wherein the length-weighted proportion of fibres having a length below 0.2 mm in the second pulp is 5.0-9.0%, preferably 5.2-7.8%, when measured according to TAPPI T271.
12. The use of any one of the preceding items, wherein the amount of filler in the pulp mixture is below 5% by dry weight, preferably below 2% by dry weight, more preferably 0% by dry weight.
13. The use of any one of the preceding items, wherein the container is bottle-shaped.
14. The use of any one of the preceding items, wherein the container is a pod part, capsule part, tray, bowl or cup.
15. Pulp mixture comprising:

65-90%, such as 70-84%, by dry weight of a first pulp, which is an optionally refined resuspended softwood market pulp having a Schopper-Riegler (SR) number of below 48, preferably below 40, more preferably below 30; and 10-35%, such as 16-30%, by dry weight of a second pulp, which is refined resuspended softwood market pulp having a Schopper-Riegler (SR) number of 60-90, preferably 70-90, more preferably 77-90.

16. The pulp mixture of item 15, wherein the length-weighted fibre length of the first pulp is above 1.75 mm, such as 1.8-2.2 mm according to TAPPI T271.
17. The pulp mixture of item 15 or 16, wherein the length-weighted fibre length of the second pulp is 1.2-1.75 mm, such as 1.3-1.7 mm according to TAPPI T271.
18. The pulp mixture of any one of items 15-17, wherein the length-weighted proportion of fibres having a length below 0.2 mm in the first pulp is below 5.0%, preferably below 4.1%, when measured according to TAPPI T271.
19. The pulp mixture of any one of items 15-18, wherein the length-weighted proportion of fibres having a length below 0.2 mm in the second pulp is 5.0-9.0%, preferably 5.2-7.8%, when measured according to TAPPI T271.
20. The pulp mixture of any one of items 15-19, wherein the amount of filler in the pulp mixture is below 5% (by dry weight), preferably below 2% (by dry weight), more preferably 0% (by dry weight).
21. A method comprising the steps of:

a) providing a first pulp having a Schopper-Riegler (SR) number of below 48, preferably below 40, more preferably below 30;
b) subjecting a first part of the first pulp to low consistency (LC) refining to obtain a second pulp having a Schopper-Riegler (SR) number of 60-90, preferably 70-90, more preferably 77-90;
c) mixing a second part of the first pulp with the second pulp in such proportions that a pulp mixture comprising 65-90%, such as 70-84%, by dry weight of the first pulp and 10-35%, such as 16-30%, by dry weight of the second pulp is obtained.

22. The method of item 21, wherein the energy supply of the LC refining is 150-500 kWh/tonne dry pulp, such as 220-500 kWh/tonne dry pulp.
23. The method of item 21 or 22, further comprising the step of:

d) forming a container from the pulp mixture in a mould.

24. The method of item 23, wherein step d) comprises a substep of dewatering the pulp mixture in the mould.
25. The method of item 23 or 24, further comprising the step of:

e) applying a barrier layer to the container.

DESCRIPTION

Figure 1:
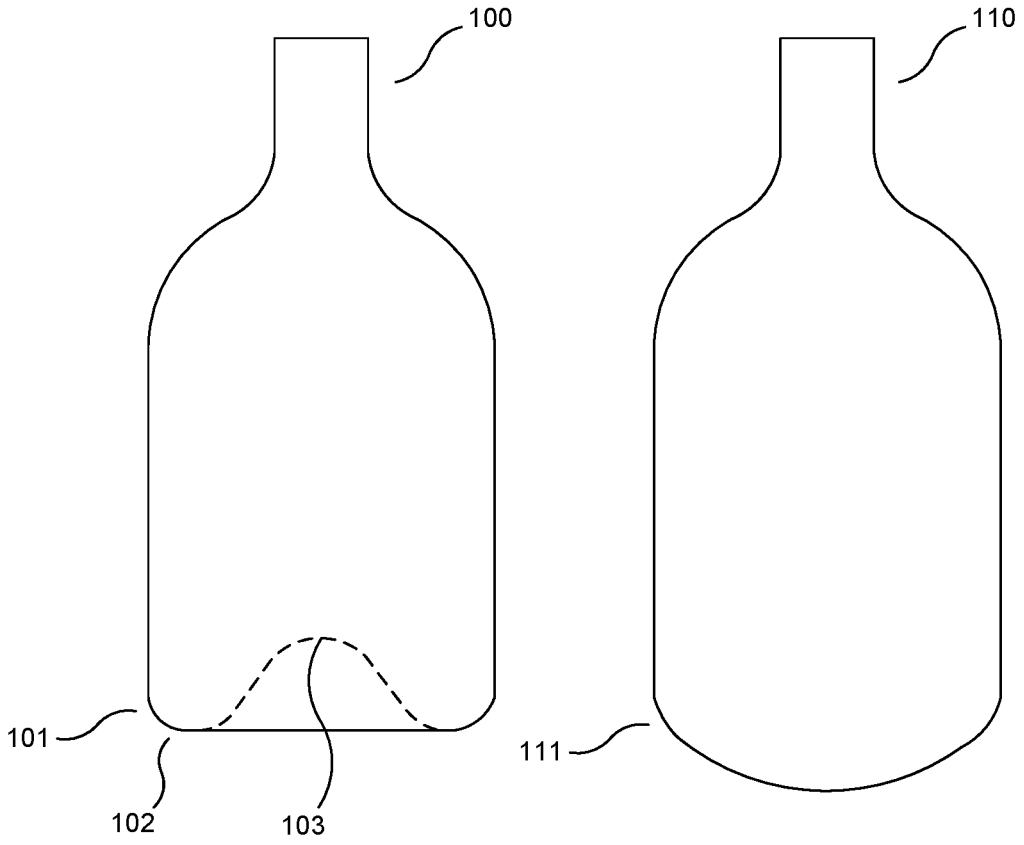
FIG. 1 illustrates bottle-shaped containers that can be formed in moulds from a pulp mixture according to the present disclosure. The bottle-shaped container 100 has a "champagne" bottom 101 meaning that that the bottom has an outer, circular convex part 102 and an inner concave part 103. The convex part 102 and the concave part 103 are concentric. The bottle-shaped container 110 has a convex bottom 111. The bottoms 101, 111 of the bottle-shaped containers 100, 110 are designed to withstand a great internal pressure. Accordingly, the bottle-shaped containers 100, 110 can be used for bottles for carbonated liquids. In such bottles, the inside and optionally also the outside of the bottle-shaped containers 100, 110 is/are coated with at least one barrier layer.
Figure 2:
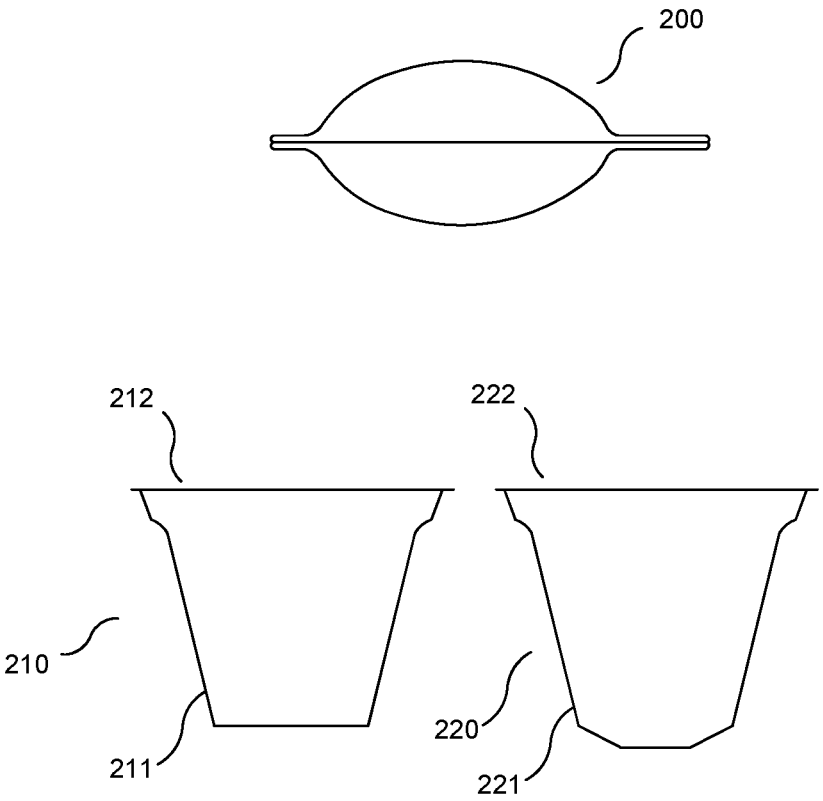
FIG. 2 illustrates a coffee pod 200 and two coffee capsules 210, 220. The coffee pod 200 comprises two halves ("clamshells"), each of which may be formed in a mould from a pulp mixture according to the present disclosure. Each coffee pod 210, 220 comprises a cup-shaped part 211, 221 and a lid 212, 222. A container formed according to the present disclosure can be used for the cup-shaped parts 211, 221. In the coffee capsules 210, 220, the inside and optionally also the outside of cup-shaped parts 211, 221 may be coated with at least one barrier layer.

As a first aspect of the present disclosure, there is provided a pulp mixture. The pulp mixture is preferably used for forming a container in a mould, e.g. according to one of the methods discussed in the background section. The container formed from the pulp mixture is preferably shaped as a bottle, tray, bowl or cup. The formed container can for example be used for a bottle for carbonated liquids, a coffee capsule or a coffee pod.

The pulp mixture comprises:

65-90% (by dry weight) of a first pulp, having a lower Schopper-Riegler (SR) number, i.e. a SR number of below 48; and 10-35% (by dry weight) of a second pulp having a higher SR number, i.e. of 60-90.

The SR numbers of the present disclosure are preferably measured according to ISO 5267-1.

Accordingly, the first pulp is typically unrefined or only modestly refined, while the second pulp is typically highly refined. Degrees of refining for the first and second pulp is further discussed below in connection with the third aspect.

It follows that the average fibre length is typically greater in the first pulp than in the second pulp. For example, the length-weighted fibre length (TAPPI T271) may be above 1.75 mm, preferably 1.8-2.2 mm in the first pulp and 1.2-1.75 mm, preferably 1.3-1.7 mm, in the second pulp. It is however shown in the Examples below that the length-weighted fibre length of the second pulp can be above 2 mm. The average fibre length in the second pulp thus appears to be of limited importance.

The average fibre length is preferably measured according to the TAPPI standard TAPPI T271. The measurement according to TAPPI T271 is preferably carried out using the equipment kajaaniFS300.

It also follows that the fines content is typically lower in the first pulp than in the second pulp. The fines content may be defined as the length-weighted proportion of fibres having a length below 0.2 mm. Such a proportion may be measured according to TAPPI T271, preferably using the equipment kajaaniFS300.

The length-weighted proportion of fibres having a length below 0.2 mm in the first pulp is typically below 5.0%, preferably below 4.1% and more preferably below 3.9%. A lower limit may for example be 2.0%.

The length-weighted proportion of fibres having a length below 0.2 mm in the second pulp is typically 5.0-9.0%, preferably 5.2-7.8% and more preferably 5.3-7.6%.

The SR number of the first pulp is preferably below 40 and more preferably below 30. A typical lower limit for the SR number of the first pulp is 10 or 15. The SR number of the second pulp is preferably 70-90 and more preferably 77-90.

The proportion by weight of the first pulp is preferably 70-84%, which means that the proportion by weight of the first pulp is preferably 16-30%.

Filler particles generally decrease the strength of the container wall. Therefore, the amount of filler in the pulp mixture is preferably below 5% by dry weight and more preferably below 2%. In one embodiment, no filler particles have been added to the pulp mixture.

As shown in the examples below, the best results were obtained for market pulps. In a preferred embodiment, the first pulp is thus formed from market pulp. The term "market pulp" implies that the pulp has been dried, which has impact on fibre properties. Market pulp is thus different from never-dried pulp. Before forming part of the pulp mixture of the first aspect, the market pulp is thus resuspended, e.g. in a pulper. The second pulp may also be formed from market pulp.

A "refined resuspended pulp" according to the present disclosure may be refined before and/or after it has been resuspended. It is preferred that most of the refining is carried out after the pulp has been resuspended.

The fibres are generally longer in softwood pulp than in hardwood pulp, which means that softwood pulp generally forms stronger container walls. It is therefore preferred that the first pulp and/or the second pulp comprise(s) softwood pulp.

For example, at least 50%, preferably at least 75%, more preferably at least % by dry weight of the first and/or second is softwood pulp.

Further, the fibres are generally longer in chemical pulp than in CTMP or TMP. It is therefore preferred that the first pulp and/or the second pulp comprise(s) chemical pulp.

For example, at least 50%, preferably at least 75%, more preferably at least 90% by dry weight of the first and/or second is chemical pulp.

Accordingly, the first and the second pulp are preferably chemical softwood pulps.

It may be easier to comply with regulations for food packages if bleached pulp is used. Further, bleached pulp generally has no odour problems and typically interacts better with pulp chemicals than unbleached pulp. Accordingly, the first pulp is preferably bleached. The second pulp may be bleached or unbleached, but preferably, it is bleached (for the same reasons). For example, the brightness of the bleached pulp may be at least 78% or at least 80% according to ISO 2470-1. Preferably, it is at least 83%.

A preferred embodiment of the pulp mixture comprises:

- 65-90%, such as 70-84%, by dry weight of the first pulp, which in this embodiment is a resuspended softwood market pulp having a Schopper-Riegler (SR) number of below 48, preferably below 40, more preferably below 30; and
- 10-35%, such as 16-30%, by dry weight of the second pulp, which in this embodiment is a refined resuspended softwood market pulp having a Schopper-Riegler (SR) number of 60-90, preferably 70-90, more preferably 77-90.

The pulp mixture may comprise at least one hydrophobic sizing agent and/or a paper strength chemical, such as starch.

As a second aspect of the present disclosure, there is provided a use of a pulp mixture according to the first aspect for forming a container in a mould.

The container of the second aspect may for example be bottle-shaped, tray-shaped, bowl-shaped or cup-shaped. The bottom of a bottle-shaped container of the present disclosure is preferably non-flat. Thereby, it can withstand greater internal pressures. For example, the non-flat bottom may be convex or shaped as a champagne bottom, i.e. having a convex outer part and a concave inner part. In one embodiment, the container is adapted to form part of a bottle for liquids, such as carbonated liquids. In addition to a bottle-shaped container according to the second aspect, such a bottle for liquids may comprise at least one barrier layer. Further, the container of the second aspect may be adapted to form part of a pod or a capsule, such as a coffee pod or a coffee capsule.

As a second aspect of the present disclosure, there is provided a method comprising the steps of:

a) providing a first pulp having a Schopper-Riegler (SR) number of below 48, preferably below 40, more preferably below 30;

b) subjecting a first part of the first pulp to low consistency (LC) refining to obtain a second pulp having a Schopper-Riegler (SR) number of 60-90, preferably 70-90, more preferably 77-90;

c) mixing a second part of the first pulp with the second pulp in such proportions that a pulp mixture comprising 65-90%, such as 70-84%, by dry weight of the first pulp and 10-35%, such as 16-30%, by dry weight of the second pulp is obtained.

Embodiments of the first pulp and the second pulp are described above in connection with the first aspect.

The energy supply of the LC refining is preferably 150-500 kWh/tonne dry pulp, such as 220-500 kWh/tonne dry pulp.

The LC refining is preferably carried out at a consistency of 2-6%.

The method may further comprise the step of:

d) forming a container from the pulp mixture in a mould.

Step d) typically comprises a substep of dewatering the pulp mixture in the mould.

Various examples of containers that may be produced by the method are discussed above.

The method may further comprise the step of:

e) applying a barrier layer to the container. The barrier layer may for example be a water and/or gas barrier layer.

EXAMPLES

Various pulps used as starting materials were obtained:

Never-dried bleached softwood pulp that had been subjected to 100-125 kWh/tonne dry pulp of refining ("ND SW")

Unbleached never-dried softwood pulp that had been subjected to 500 kWh/tonne dry pulp of refining ("Brown NDHR")

Bleached never-dried hardwood pulp that had been subjected to 135 kWh/tonne dry pulp of refining ("White NDHR")

Bleached softwood market pulp that had been subjected to 50 kWh/tonne dry pulp of refining before drying ("M SW 50")

Part of the M SW 50 pulp was suspended in water and subjected to further refining to obtain the following pulps:

Bleached softwood market pulp that had been subjected to a total of 150 kWh/tonne dry pulp of refining ("M SW 150")

Bleached softwood market pulp that had been subjected to a total of 300 kWh/tonne dry pulp of refining ("M SW 300")

Bleached softwood market pulp that had been subjected to a total of 750 kWh/tonne dry pulp of refining ("M SW 750")

The characteristics of the pulps were measured and are presented in the table 1 below.

TABLE 1

All values from STFI FiberMaster and the kajaaniFS300 are length-weighted.

| Pulp | ND SW | Brown NDHR | White NDHR | M SW 50 | M SW 150 | M SW 300 | M SW 750 |
|---|---|---|---|---|---|---|---|
| SR* | 22 | 72 | 80 | 22 | 49 | 85 | 96 |
| Fibre length** | 1.98 mm | 2.10 mm | 0.68 mm | 1.78 mm | 1.68 mm | 1.36 mm | 0.63 mm |
| Fines** | 15% | 29% | 30% | 13% | 16% | 24% | 56% |
| Fibre length*** | — | — | — | 2.03 mm | 1.93 mm | 1.57 mm | 0.78 mm |
| Fines*** | — | — | — | 3.41% | 4.51% | 6.02% | 9.45% |

*Measured according to ISO 5267-1

**Measured with a STFI FiberMaster. When the fines content was measured with the STFI FiberMaster, all fibres shorter than 0.5 mm were considered to be "fines".

***Measured with a kajaaniFS300 according to TAPPI standard (TAPPI T271). When the fines content was measured with the kajaaniFS300, all fibres shorter than 0.2 mm were considered to be "fines".

Various mixtures were prepared from the pulps in table 1. The mixtures are presented in table 2 below. Further, bottle-shaped containers were formed in a mould from the pulp mixtures. The dewatering of the pulp mixtures in the mould was studied. After drying, the weight of each container formed in the mould was registered. The containers were then pressurized and the pressure at which each container exploded was registered. For all pulp mixtures but one, at least three containers were formed and included in the pressurizing test. The results are presented in table 2 below.

TABLE 2

| Pulp mixture | Avg. explosion pressure (bar) | Container weight (g) | Avg. explosion pressure index (bar/g) | Acceptable dewatering (Yes/No) |
|---|---|---|---|---|
| 50% ND SW + 50% Brown NDHR | 7.1 | 18.6 | 0.38 | No |
| 75% ND SW + 25% Brown NDHR | 10 | 23 | 0.43 | Yes |
| 25% ND SW + 75% Brown NDHR | 5 | 16.6 | 0.29 | No |
| 50% ND SW + 50% White NDHR | 8 | 29 | 0.28 | No |
| 85% ND SW + 15% Brown NDHR | 10.2 | 19.5 | 0.52 | Yes |
| 100% M SW 50 | 7.8 | 20 | 0.39 | Yes |
| 100% M SW 150 | 9.3 | 22.1 | 0.42 | No |
| 100% M SW 300 | 3.4 | 13 | 0.27 | No |
| 75% M SW 50 + 25% M SW 300 | 10.5 | 17.8 | 0.59 | Yes |
| 85% M SW 50 + 15% M SW 300 | 8.4 | 18.3 | 0.46 | Yes |
| 75% M SW 150 + 25% M SW 300 | 8.88 | 18.1 | 0.49 | No |
| 85% M SW 150 + 15% M SW 300 | 10.4 | 19.3 | 0.54 | No |
| 85% M SW 50 + 15% M SW 750* | 4.9 | 11 | 0.46 | No |

*two containers were formed and included in the pressurizing test

Seven different pulp mixtures resulted in an average explosion pressure of above 8 bar and an average explosion pressure index of above 0.4 bar/g. Only four of them, however, also showed acceptable dewatering and are therefore presented in table 3 below.

By comparing the three first pulp mixtures in table 2, it is observed that a mixture of equal parts of a low-SR pulp (ND SW) and a high-SR pulp (Brown NDHR) resulted in relatively low explosion pressures and unacceptable dewatering. Increasing the proportion of the high-SR pulp resulted in even lower explosion pressures. Increasing the proportion of the low-SR pulp to % resulted however in significantly increased explosion pressures and an acceptable dewatering.

It is notable that "100% M SW 150", which consisted of a single, intermediately refined bleached softwood market pulp (SR: 49; fibre length: 1.93 mm; and fines: 4.51%), showed relatively high explosion pressures, but unacceptable dewatering. In contrast, "75% M SW 50+25% M SW 300" and "85% M SW 50+15% M SW 300", which consisted of a mixture of a major part low-refined bleached softwood market pulp and a minor part high-refined bleached softwood market pulp, showed acceptable dewatering and even higher explosion pressures.

When a minor part of the high-refined bleached softwood pulp (M SW 300) was added to the intermediately refined bleached softwood market pulp (M SW 150), the average explosion pressure index was increased, but the dewatering was still unacceptable.

It is also notable that "85% M SW 50+15% M SW 750", which consisted of a mixture of a major part low-refined bleached softwood market pulp and a minor part very high-refined bleached softwood market pulp (SR; 96; fibre length: 0.78 mm; and fines: 9.45%) resulted in underweight containers and unacceptable dewatering. The biggest difference between the "high-refined" and "very high-refined" bleached softwood market pulp is the fines content. It may thus be preferred to avoid too high fines contents, such as fines contents above about 8% (TAPPI T271 using the 0.2 mm limit).

TABLE 3

| Pulp mixture | SR | Avg. explosion pressure (bar) | Avg. explosion pressure index (bar/g) |
|---|---|---|---|
| 75% ND SW + 25% Brown NDHR | 22<br>72 | 10.0 | 0.43 |
| 85% ND SW + 15% Brown NDHR | 22<br>72 | 10.2 | 0.52 |
| 75% M SW 50 + 25% M SW 300 | 22<br>85 | 10.5 | 0.59 |
| 85% M SW 50 + 15% M SW 300 | 22<br>85 | 8.4 | 0.46 |

In table 3 it is shown that the highest explosion pressure as well as the highest average explosion pressure index was obtained for a mixture of 75% low-refined bleached softwood market pulp (SR: 22; fibre length: 2.03 mm; and fines: 3.41%) and 25% high-refined bleached softwood market pulp (SR: 85; fibre length: 1.57 mm; and fines: 6.02%).

The invention claimed is:

1. A molded container that comprises a pulp mixture, the pulp mixture including:

65-90% by dry weight of a first pulp, which is a resuspended softwood market pulp having an average length-weighted fiber length of above 1.75 mm and having a Schopper-Riegler (SR) number according to ISO 5267-1 of below 48; and 10-35% by dry weight of a second pulp having an average length-weighted fiber length that is less than the average length of the first pulp, and a Schopper-Riegler (SR) number according to ISO 5267-1 of 60-90.

2. The container of claim 1, wherein the second pulp is a refined resuspended market pulp.

3. The container of claim 2, wherein the first pulp comprises at least 75% chemical softwood pulp based of the dry weight of the first pulp.

4. The container of claim 2, wherein the first pulp comprises at least 90% chemical softwood pulp based of the dry weight of the first pulp.

5. The container of claim 2, wherein the first pulp comprises at least 50% chemical softwood pulp-based of the dry weight of the first pulp.

6. The container of claim 1, wherein the length-weighted proportion of fibers having a length below 0.2 mm in the first pulp is below 5.0%, when measured according to TAPPI T271.

7. The container of claim 1, wherein the length-weighted proportion of fibers having a length below 0.2 mm in the second pulp is 5.0-9.0%, when measured according to TAPPI T271.

8. The container of claim 1, wherein the amount of filler in the pulp mixture is below 5% by dry weight.

9. The container of claim 1, wherein the container is bottle-shaped.

10. The container of claim 1, wherein the container is a pod part, capsule part, tray, bowl or cup.

11. The container of claim 1, comprising 70-84% by dry weight of the first pulp.

12. The container of claim 1, wherein the Schopper-Riegler (SR) number according to ISO 5267-1 of the first pulp is below 40.

13. The container of claim 1, wherein the Schopper-Riegler (SR) number according to ISO 5267-1 of the first pulp is below 30.

14. The container of claim 1, comprising 16-30% by dry weight of the second pulp.

15. The container of claim 1, wherein the Schopper-Riegler (SR) number according to ISO 5267-1 of the second pulp is 70-90.

16. The container of claim 1, wherein the Schopper-Riegler (SR) number according to ISO 5267-1 of the second pulp is 77-90.

17. A method comprising the steps of:

a) providing a first pulp, which is a resuspended softwood market pulp having an average length-weighted fiber length of above 1.75 mm having a Schopper-Riegler (SR) number according to ISO 5267-1 of below 48;

b) subjecting a first part of the first pulp and to low consistency (LC) refining to obtain a second pulp having an average length-weighted fiber length that is less than the average length of the first pulp, and having a Schopper-Riegler (SR) number according to ISO 5267-1 of 60-90;

c) mixing a second part of the first pulp with the second pulp in such proportions that a pulp mixture comprising 65-90% by dry weight of the first pulp and 10-35%, by dry weight of the second pulp is obtained.

18. The method of claim 17, wherein the energy supply of the LC refining is 150-500 kWh/ton dry pulp.

19. The method of claim 17, further comprising the step of:

d) forming a container from the pulp mixture in a mold.

20. The method of claim 17, wherein step d) comprises a substep of dewatering the pulp mixture in the mold.

21. The method of claim 17, further comprising the step of:

e) applying a barrier layer to the container.

* * * * *